US007373755B2

(12) United States Patent
Jefferys et al.

(10) Patent No.: US 7,373,755 B2
(45) Date of Patent: May 20, 2008

(54) SAFETY GATE ASSEMBLY

(75) Inventors: Patrick Crawford Jefferys, Surrey (GB); Vaughan Stephen Newcombe, Hampshire (GB)

(73) Assignee: Bettacare Limited (GB)

( * ) Notice: Subject to any disclaimer, the term of this patent is extended or adjusted under 35 U.S.C. 154(b) by 452 days.

(21) Appl. No.: 11/224,044

(22) Filed: Sep. 13, 2005

(65) Prior Publication Data

US 2006/0055182 A1 Mar. 16, 2006

(30) Foreign Application Priority Data

Sep. 16, 2004 (GB) ..... 0420651.2

(51) Int. Cl.
*E06B 3/68* (2006.01)

(52) U.S. Cl. ..... 49/55; 49/57; 49/394; 49/465

(58) Field of Classification Search ..... 49/55, 49/57, 465, 463, 50; 292/163, DIG. 29, 292/137, 169

See application file for complete search history.

(56) References Cited

U.S. PATENT DOCUMENTS

| | | | | |
|---|---|---|---|---|
| 6,112,461 | A | 9/2000 | Cheng | |
| 6,637,784 | B1 * | 10/2003 | Hauber et al. | 292/300 |
| 2002/0002795 | A1 * | 1/2002 | Rogers | 49/57 |
| 2002/0007597 | A1 * | 1/2002 | Wang | 49/463 |
| 2004/0045222 | A1 * | 3/2004 | Hicks | 49/394 |

FOREIGN PATENT DOCUMENTS

| | | |
|---|---|---|
| WO | 02/48496 | 6/2002 |

* cited by examiner

*Primary Examiner*—David V Bruce
*Assistant Examiner*—Catherine A Kelly
(74) *Attorney, Agent, or Firm*—Lowe Hauptman Ham & Berner, LLP

(57) ABSTRACT

A safety gate assembly includes a frame which may be secured across a door opening, stairway or the like and comprises a base and two upstanding limbs and a gate. One side of the gate is connected by one or more pivotal connections to the one limb of the frame to permit pivotable movement of the gate with respect to the frame about a pivotal axis. The other side of the gate carries a latch member, which cooperates with a latch connected to the other limb of the frame. The latch defines a locked position, in which pivotable movement of the gate is prevented. The pivotal connection is constructed to permit linear movement of the gate relative to the frame in a direction parallel to the pivotal axis. The latch member cooperates with a biasing spring arranged to urge the latch member in the direction away from the said one side of the gate. The latch defines a recess, which is adapted to accommodate a portion of the latch member and laterally adjacent which is an entry ramp and extending vertically into which is an exit ramp. The entry ramp is constructed and arranged so that when the gate is pivoted into the closed position the latch member engages the entry ramp and is moved progressively against the force of the biasing means in the direction towards the said one side of the gate until the latch member is in registry with the recess and the biasing means then urges the latch member into the recess. Further pivotal movement of the gate is then prevented and the gate is in a locked position. The exit ramp is constructed and arranged so that when the gate is moved linearly upwardly, the latch member engages the exit ramp and is moved by it progressively in the direction towards the said one side of the gate until it is out of the recess, whereafter the gate may be moved pivotally into the open position.

9 Claims, 6 Drawing Sheets

SAFETY GATE ASSEMBLY

FIELD OF THE INVENTION

The present invention relates to a childproof safety gate assembly, particularly of self-closing and self-latching type, which can be fitted across a doorway, stairway, or the like. A childproof safety gate is one which may be readily opened by an adult but which a small child is incapable of opening. More specifically, the present invention relates to a safety gate assembly of the type including a frame which may be secured across a door opening, stairway or the like, the frame comprising a base and at least one upstanding limb, and a gate, one side of which is connected by one or more pivotal connections to the one limb of the frame to permit pivotal movement of the gate with respect to the frame about a pivotal axis and the other side of which carries a projecting latch member, which cooperates with a latch connected to the other side of the frame, the latch defining a locked position, in which pivotal movement of the gate is prevented, the pivotal connection being constructed to permit linear movement of the gate relative to the frame in a direction parallel to the pivotal axis.

DESCRIPTION OF THE PRIOR ART

Safety gates are structures which are employed to prevent babies and young children from accessing certain areas to which they are to be denied access. They may also be used for controlling the movements of household pets. A safety gate may be fixed across a stairway or door opening to provide a secure barrier to prevent young children from falling downstairs or entering rooms in a home.

The disadvantage with known safety gates of this type is firstly that larger children tend to learn to unlatch the gate and thus to gain access to areas to which they are suppose to have no access and secondly that the gate is sometimes accidentally left open by adults or older children.

A safety gate of the type referred to above is disclosed in WO 02/48496. This gate is of self-closing type and when the gate moves towards the closed position, the latch member moves through an entry into a recess in the latch. As the gate reaches the closed position, it moves downwardly under gravity and the latch member moves downwardly in the latch into a position in which it is no longer aligned with the entry. Pivotal movement of the gate is thus prevented and the gate is latched. It may only be unlatched by moving the latch member upwardly and laterally along a complex path within the latch until it is again in registry with the latch entry. It is beyond the ability of young children to effect the necessary complex movement of the gate relative to the gate and the gate is thus "childproof".

The self-closing function of the gate is produced by the fact that the weight of the gate is carried by two opposed pins which bear on respective helical ramps carried by a support member. The support member affords two downwardly extending opposed slots and when the gate reaches the closed position, the opposed pins enter with into alignment with the slots and the entire gate moves downwardly, thus effecting latching of the latch member in the latch.

It is of course crucial that the gate moves downwardly precisely at the point which the gate reaches the closed position. If it were to move downwardly before the fully closed position were reached, the gate would not latch. If the gate were to reach the fully closed position before it has moved downwards, the gate would again not latch. It is, therefore, in practice essential that the pins are a very close fit in the slots and that the slots are very precisely aligned with the closed position of the gate. However, it is found that an angular misalignment can easily occur inadvertently during manufacture. Furthermore, if a significant force is applied to the gate whilst it is closed and latched, this force is transmitted in the form of a torque via the pins to the support member. This can result in damage to the support member and also in misalignment of it and of the slots leading to failure to latch properly, as discussed above.

It is therefore the object of the invention to provide a safety gate in which the latch and optionally also the self-closing mechanism, if present, are such that the problems discussed above are eliminated.

SUMMARY OF THE INVENTION

According to the present invention, in a safety gate assembly of the type referred to above, the latch member cooperates with biasing means arranged to move the latch member in the direction away from the said one side of the gate and the latch defines a recess, which is adapted to accommodate a portion of the latch member and laterally adjacent which is an entry ramp and extending vertically into which is an exit ramp, the entry ramp being constructed and arranged so that when the gate is pivoted into the closed position the latch member engages the entry ramp and is moved by it progressively against the force of the biasing means in the direction towards the said one side of the gate until the latch member is in registry with the recess and the biasing means then urges the latch member into the recess and further pivotal movement of the gate is prevented and the gate is in the locked position, the exit ramp being constructed and arranged so that when the gate is moved linearly upwardly the latch member engages the exit ramp and is moved by it progressively in the direction towards the said one side of the gate until it is out of the recess, whereafter the gate may be moved pivotally into the open position.

The gate in accordance with the invention is thus similar to that disclosed in WO 02/48496 in that it can move vertically between two positions and is latched in one of them and unlatched in the other. However, the gate in accordance with the prior documents is normally in the higher position and only enters the lower position when it is latched. The gate in accordance with the present invention, on the other hand, is normally in the lower position and is latched in the lower position and is only moved into the higher position to unlatch it. The construction of the latch is also very different to that in the prior document because the gate includes a latch member which is biased outwardly, that is to say away from the hinge connections, and the latch includes an entry ramp which is engaged by the latch member as the gate is closed and progressively forces the latch member inwardly, that is to say towards the hinge connections, against the biasing force acting on it. As the gate continues to move, the latch member move into alignment with the recess in the latch and the biasing means then moves the latch member outwardly, that is to say into the recess. The gate is then latched. Communicating with the recess is an exit ramp which extends upwardly and towards the hinge connections. If the gate is moved bodily upwardly, the latch member slides along the exit ramp and is progressively moved towards the hinge connections until it is outside the recess, whereafter the gate may be opened. This method of latching and unlatching is simpler than that in the prior document and the different configuration and manner of use of the latch means that there is no danger of the support member, if present, being damaged. Furthermore, the risk present in the gate assembly of the prior document of failing to latch is eliminated.

The frame may be of generally L shaped with the gate connected to the upstanding limb and the latch connected to the wall doorframe or the like at the position where the gate is secured. It is, however, preferred that the frame is of generally U shape and has two upstanding limbs and the latch is connected to the other upstanding limb.

In the preferred construction, a depression is formed in the surface of the latch member which extends on both sides of the recess and is thus divided by it into two portions, one end of one portion communicating with the entry ramp and the other end of the said one portion communicating with the recess, one end of the other portion communicating with the recess and the other end of the said other portion terminating before the associated side surface of the latch member and thus constituting an abutment surface. The latch has a surface facing the gate and it would be possible for the entry ramp to extend all the way to this surface. If this were the case and if the gate were slammed very violently, it would be possible for the gate to be moving so rapidly that the biasing means would be unable to react sufficiently rapidly to force the latch member into the recess and this would result in the gate moving through the fully closed position and failing to latch. However, if the aforementioned depression is provided, if the gate is slammed violently and the latch member fails to engage in the recess, it will impact against the abutment surface at the end of the depression, thereby preventing the gate from moving significantly beyond the closed position. In practice, the latch and gate will rebound from the abutment surface and on the second occasion that the latch member comes into alignment with the recess the biasing means will move the latch member into the recess and thus latch the gate in the closed position.

Depending on the configuration of the doorway, stairway or the like in which the gate assembly is to be secured, it may be desirable for the gate to open in the clockwise or anti-clockwise direction. It is, however, desirable for the latch member to have only a single entry ramp and it is therefore preferred that the latch member is removably connected to the frame and may thus be selectively connected to the frame in two orientations offset from one another by 180°. However, if the latch member were rotated through 180° so that the entry ramp faces in the opposite direction, the exit ramp which was previously at the top of the recess will now be at the bottom. It is therefore preferred that the latch member affords two vertically extending exit ramps communicating with the top and bottom, respectively, of the recess.

The latch member and the biasing means may take various forms but in the preferred embodiment latch member comprises an elongate pin, extending around which is a compression spring, which bears against the pin and the gate and constitutes the biasing means.

As mentioned above, the gate in accordance with the invention is moved upwardly to unlatch it and whilst small children will in practice be unable to do this, it is possible that some larger children may be able to do so. In order to prevent this, it is preferred that the gate assembly includes a locking member, which is selectively moved between a locked position, from which it prevents linear movement of the gate relative to the frame, and a released position, in which it permits such linear movement.

Although it is not essential that the gate is of self-closing type, it is preferred that it is. This self-closing function may be effected, for instance, simply by the provision of a spring. It is, however, preferred that it is affected by the weight of the gate itself and in the preferred embodiment the frame carries a support member defining a downward helical ramp on which the gate rests, the ramp extending, when viewed from above, through the plane in which the gate extends when it is in the closed position. It is preferred that the gate has a projection on its underside which engages the ramp and thus that the weight of the gate acts on the ramp over a relatively small area. The fact that the ramp extends through the plane in which the gate extends, in practice by at least 3° and more preferably by up to 10°, means that the precise angular position of the support member is not crucial and that even if it is misaligned by a few degrees, a closing force will still act on the gate up to the closed position of the gate and indeed when the gate is in the closed position. The provision of this feature is not possible in the gate assembly in accordance with the prior document because the two opposed slots in the support member lie in the plane of the gate, when it is in a closed position, and this means in practice that the downward ramp terminates slightly short of the plane in which the gate extends, when the in the closed position, when viewed from above. This feature is believed to be of great significance and to be both novel and inventive in its own right and may be provided on its own, that is to say without the novel features of the latch referred to above or the other preferred features referred to above.

It is preferred that the support member is removably connected to the frame and defines two helical ramps which are oppositely inclined, the support member being selectively connected to the frame such that a selected one of the two helical ramps is upwardly directed and supports the gate. Thus if the orientation of the latch member is reversed, as described above, to convert the gate from one which opens eg clockwise to one which opens anti-clockwise, it is necessary to ensure that the self-closing force acting on the gate also acts in the opposite direction and this may be achieved simply and effectively by the provision of this feature which enable the support member to be simply disconnected from the frame and then reconnected in the opposite orientation so that the other helical ramp, which descends in the opposite sense, is upwardly directed and supports the weight of the gate.

Further features and details of the invention will be apparent from the following description of one specific embodiment, which is given by way of example only with reference to the accompanying drawings.

DESCRIPTION OF THE PREFERRED EMBODIMENT

Figure 6:
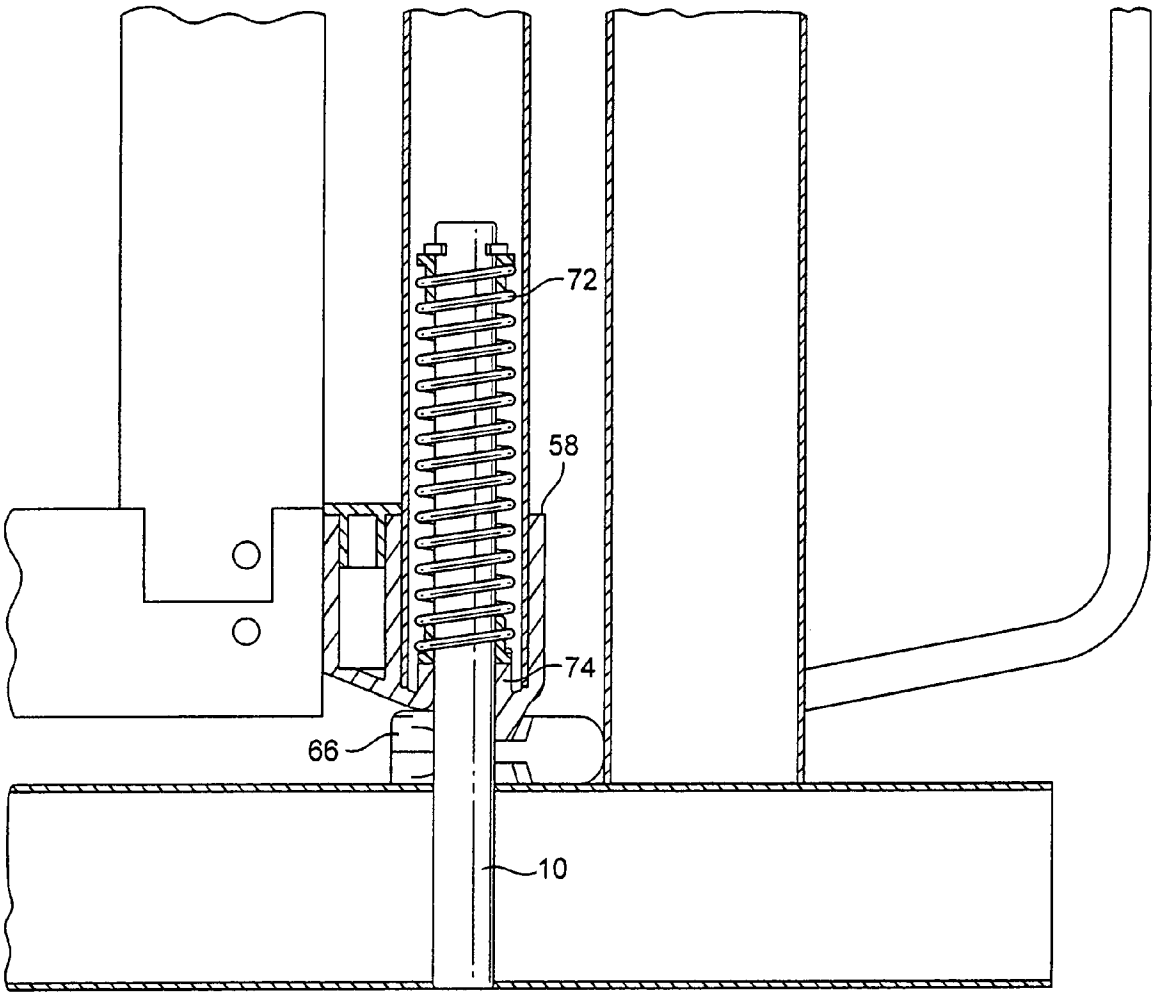
FIG. 6 is a scrap sectional view of the frame and gate showing the lower hinge and support member.

The gate assembly comprises a generally U-shaped frame comprising two vertically extending limbs 2, 4, the lower ends of which are connected by a horizontal base 6. In use, the frame is secured in position in a doorway, passage or stairway by any conventional means, such as screw threaded rods, which are received in holes at the top and bottom of each limb 2, 4 and carry clamping members at their free ends (not shown). At its upper end, the limb 2 carries a downwardly extending hinge pin 8 and at the end of the base 6 adjacent the limb 2, the base carries an upwardly extending hinge pin 10 (seen in FIG. 6). Pivotally mounted within the opening defined by the frame is a gate 12. On its side adjacent the limb 2, the gate carried a hollow, open-ended hinge tube 14 in which the hinge pins 8 and 10 are rotatably and longitudinally slidably received. The tube 14 and hinge pins 8 and 10 constitute the pivotal connection between the frame and the gate.

Figure 4:
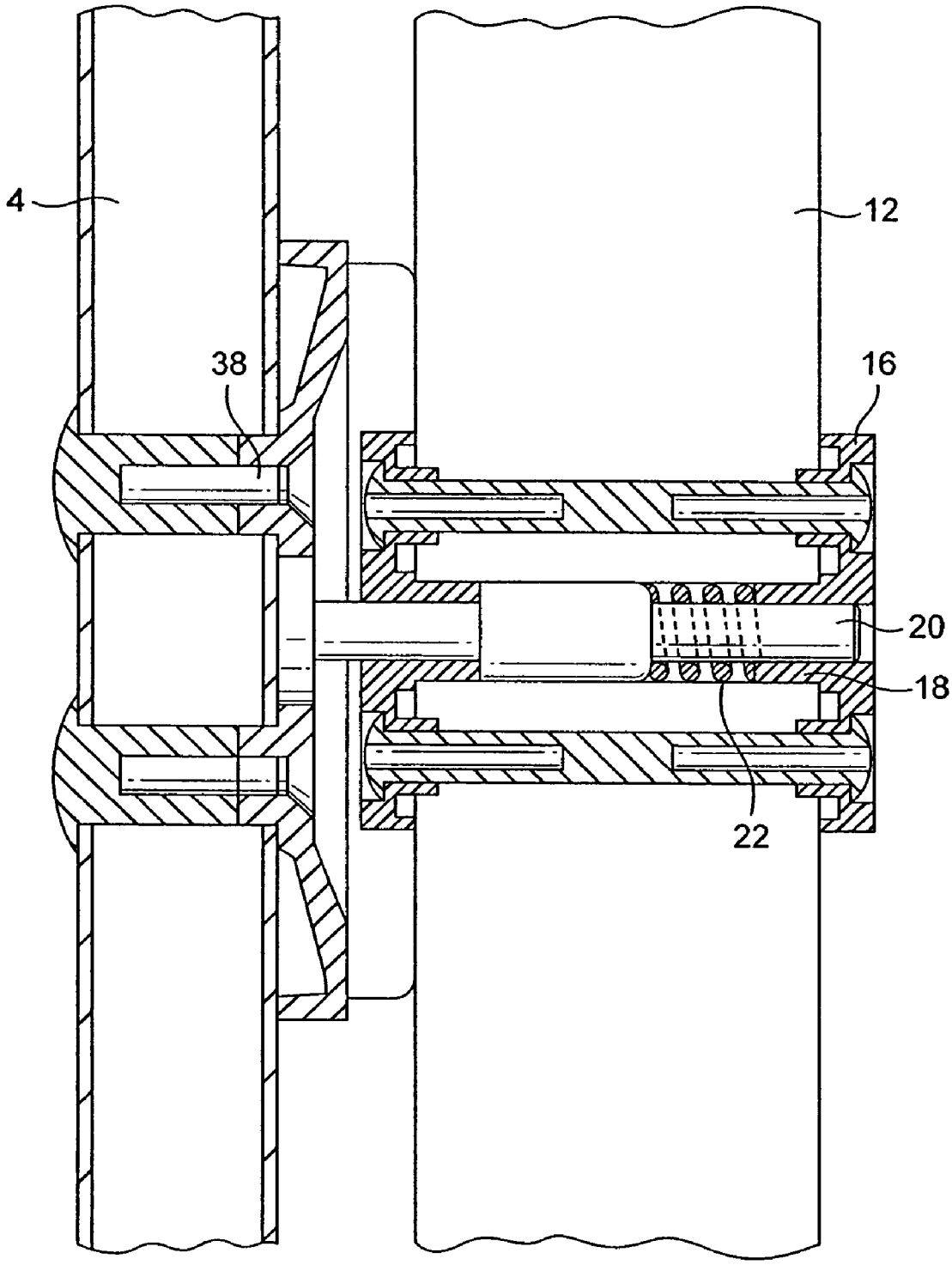
FIG. 4 is a scrap sectional view of the safety gate in the region of the latch member.

As best seen in FIG. 4, on its side remote from the hinge connection, the gate 12 carries a metallic latch fitting 16, through which a horizontal hole 18 extends. Slidably received in the hole 18 is a latch pin 20, extending around a portion of which is a compression spring 22. One end of this spring is anchored to the latch fitting 16 and the other end bears on the latch pin 20 and urges it outwardly, that is to say to the left as seen in FIG. 4.

Figure 1:
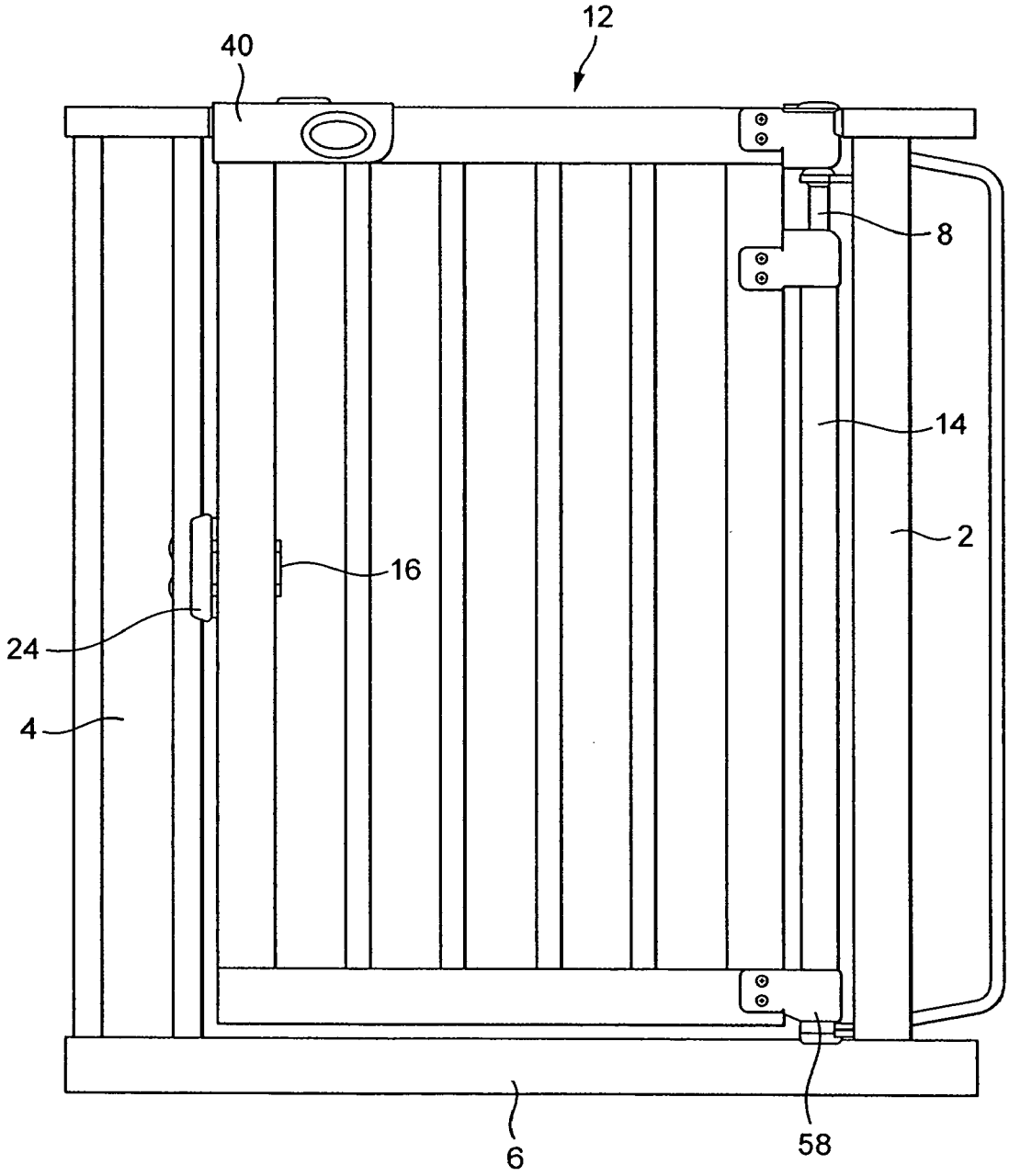
FIG. 1 is a perspective view of a children's safety gate in accordance with the invention.
Figure 2:
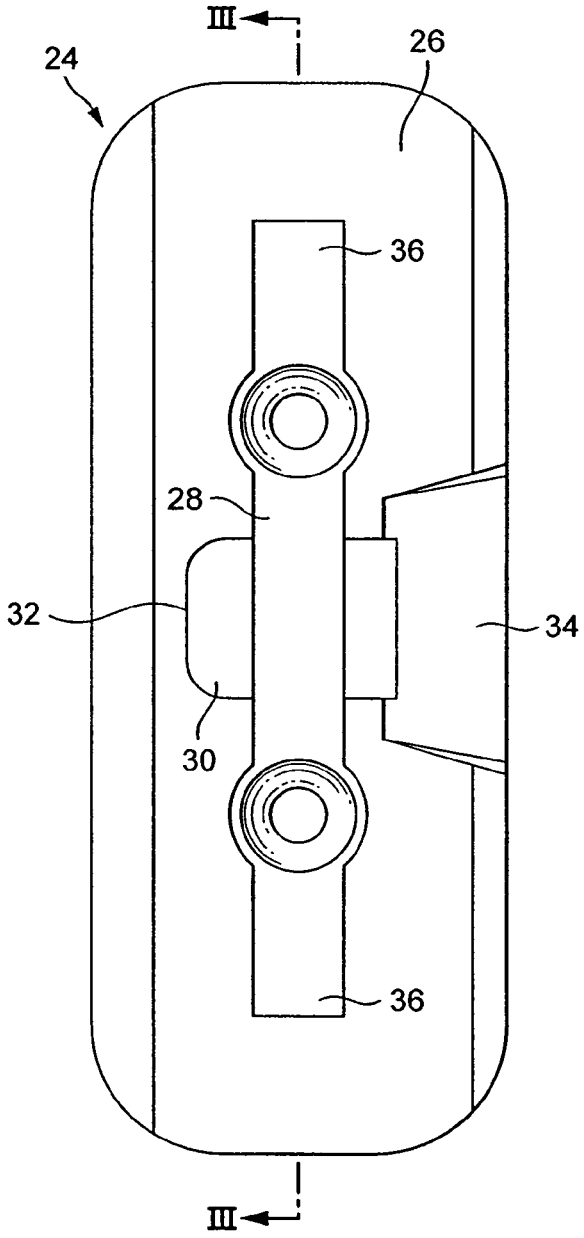
FIG. 2 is a front view of the latch.
Figure 3:
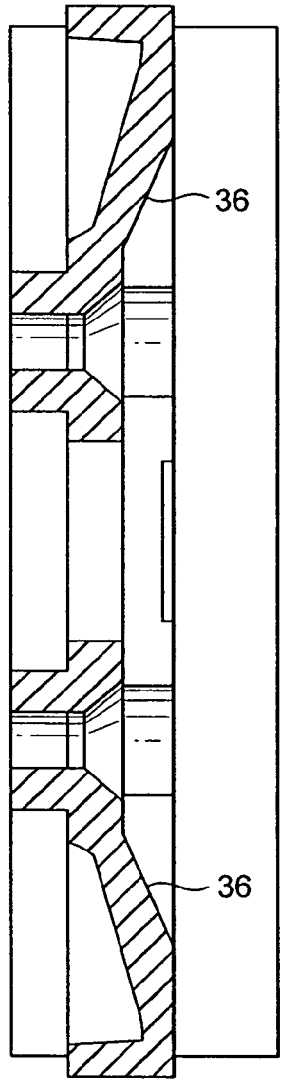
FIG. 3 is a sectional view of the line III-III in FIG. 2.

Connected to the limb 4 at a position corresponding to that of the latch fitting 16 is a further latch fitting 24 of generally rectangular shape. Formed centrally in the surface 26 of the latch fitting 24 facing the latch fitting 16 is an elongate, vertically extending latch recess 28. Also formed in the surface 26 is a depression or shallow recess 30, which communicates with the latch recess 28 and extends transversely to it on both sides of the latch recess 28 and is thus divided by it into two portions. One end of the left hand portion, as seen in FIG. 2, of the depression 40 thus communicates with the latch recess 28 and the other end of that portion terminates at a shoulder or abutment 32. One end of the other portion of the depression 32 communicates with the latch recess 28 and the other end of that portion communicates with a lateral entry ramp 34 of the latch. The entry ramp 34 constitutes a recess whose depth progressively increases from the left to the right, as seen in FIG. 2. The central portion of the latch recess 28 is of constant depth but at its two ends this depth progressively decreases to zero and these two portions of the recess 28 constitutes exit ramps 36. Formed in the base of the recess 28 at vertically spaced positions are two countersunk holes, by means of which the latch fitting 24 is removably secured to the limb 4 by fasteners 38.

Figure 5:
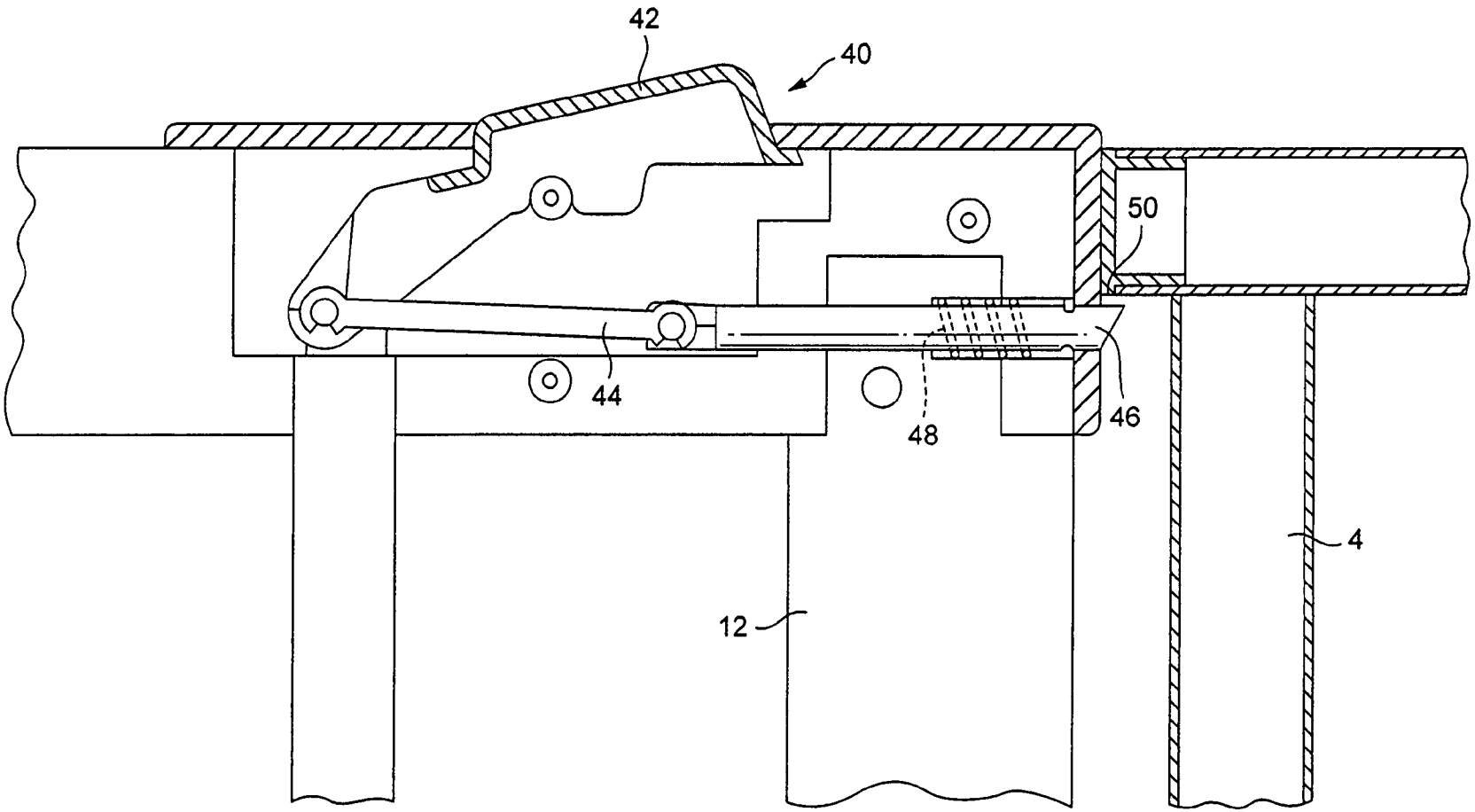
FIG. 5 is a scrap sectional view of the lock at the top of the gate.

The sliding fit of the hinge pins 8, 10 in the hinge tube 14 permits the gate to be moved vertically over a short distance whilst nevertheless remaining pivotally connected to the frame. Such linear movement may be selectively prevented by the provision of a lock 40 at the top of the gate on the side remote from the hinge connection. The lock 40 comprises a pivotally mounted lock handle 42, one end of which is connected by a linkage 44 to a spring loaded lock pin 46. In the locked position illustrated in FIG. 5, into which the lock pin 46 is biased by the spring 48, the lock pin projects laterally beyond the gate and engages beneath a ledge or projection 50 connected to the frame limb 4. In the locked position shown in FIG. 5, the lock pin 46 is situated immediately below the projection 50 and upward movement of the gate relative to the frame is therefore prevented. If downward pressure is exerted on the lock handle 42, its pivotal movement is converted into linear movement, to the left as seen in FIG. 5, of the linkage 44 and thus in the lock pin 46 being retracted against the biasing force of the spring 48 to a position in which it no longer projects beyond the side surface of the gate. Vertical movement of the gate relative to the frame is now permitted.

Figure 7:
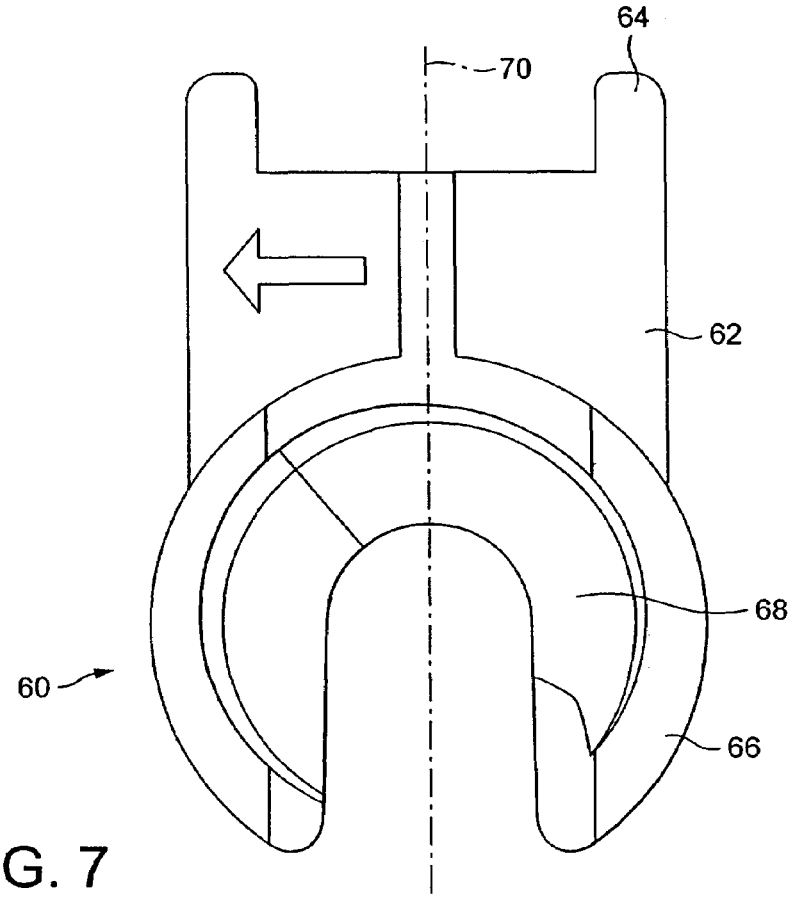
FIG. 7 is a plan view of the support member.
Figure 8:
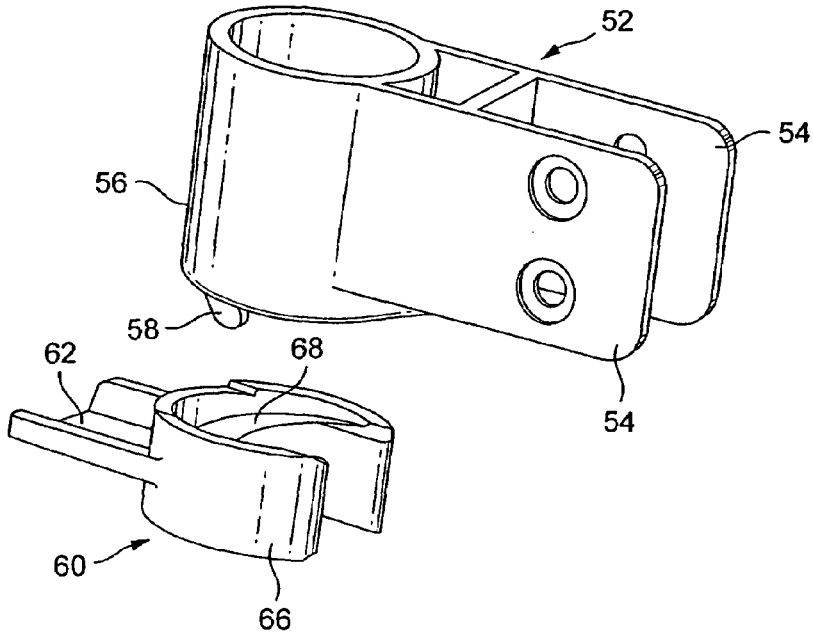
FIG. 8 is a perspective exploded view of the support fitting and support member.

Connected to the lower corner of the gate closest to the limb 2 is a first support fitting 52. As best seen in FIG. 8, this is an integral plastic moulding comprising two spaced parallel flanges 54, which are connected by screws to opposite surfaces of the gate and are integral with an open ended tubular bush 56. Integral with the lower end surface of the bush is a projection or lug 58. Removeably connected to the limb 2 is a second support fitting 60, which, as seen in FIGS. 7 and 8, is again an integral plastic moulding and comprises a generally planar region 62, projecting from which are two integral lugs 64. Integral with the planar portion 62 is a horse shoe-shaped portion 66, integral with whose inner surface are a first helical descending ramp 68 directed in one direction and a second helical ramp descending in the opposite sense. The limb 2 has two spaced apertures formed in it which removably receive the lugs 64. These lugs 64 may be readily removed from the apertures and the second support fitting turned upside down and the lugs may then be replaced in the apertures. The two helical ramps may thus be selectively directed upwardly. The length of the ramps 68 is such that, when the gate is closed, they extend through the plane 70 occupied by the gate by approximately 10-15°. In use, the gate moves downwardly on its sliding pivotal connections until the lug 58 on the underside of the first support fitting engages the upwardly directed helical ramp 68 on the second support fitting 60. The lower hinge pin 10 extends through the open bush 56 of the first support fitting into the hinge tube 14. Extending around it is a helical compression spring 72, one end of which bears against a shoulder on the hinge pin 10 and the other end of which bears on an upwardly directed annular portion 74 of the first support fitting. The spring 72 thus urges the first support fitting and thus also the gate downwardly and therefore increases the contact load between the lug 58 and the descending helical ramp 68.

If the gate is opened and then released, the weight of the gate and the biasing force of the spring 72 act through the lug 58 on the ramp 68. The angle of decent of the ramp 68 is such that this force produces a significant torque acting on the gate in the closed direction. The gate thus moves towards the closed position. As it approaches the closed position, the latch pin 20 comes into engagement with the entry ramp 34 on the latch. As pivotal movement of the gate continues, the latch pin slides up the entry ramp 34 and the latch pin is progressively moved inwardly, that is to say to the right, as seen in FIG. 4. When the latch pin reaches the depression 32, its lateral movement ceases because the depth of this depression is constant. When the latch pin reaches the latch recess 28, the biasing spring 22 urges the latch pin 20 into the latch recess.

The gate is now latched and pivotal movement of it is prevented in both directions by engagement of the latch pin in the latch recess. In this position, vertical movement of the gate is normally prevented by engagement of the lock pin 46 with the underside of the projection 50. If, however, it is now wished to open the gate, the lock handle 42 is depressed thereby retracting the lock pin 46. The gate is then lifted and such linear movement is permitted by the sliding of the hinge pins in the hinge tube. This vertical movement results in the latch pin moving up the elongate latch recess 28 until it engages the inclined exit ramp 36. Engagement with this ramp progressively urges the latch pin inwardly, that is to say to the right as seen in FIG. 4, until the latch pin reaches the end of the exit ramp and its end surface engages the surface 26 of the latch. The gate may now be opened. Even if the support fitting 60 is slightly angularly misaligned, the gate will nevertheless reliably close and latch because the descending ramp extends through the plane 70 occupied by the gate, when in the closed position. A torque is thus exerted on the gate in the closing direction, even when it is in the fully closed position.

If the gate should be slammed violently in the closing direction, it is possible that it may move so fast that the biasing spring 22 will not be able to force the latch pin into the latch recess before the latch pin has moved fully across the latch recess. In this event, the latch pin will continue moving with its end surface in sliding contact with the left-hand half, as seen in FIG. 2, of the depression 30. However, the latch pin will then engage the shoulder 32 and further pivotal movement of the gate will be prevented. As a practical matter, the gate then rebounds relatively slowly in the opposite direction until the latch pin is again in registry with the latch recess and the biasing spring then urges the latch pin into the latch recess and latches the gate.

If it should be desired to convert the gate from closing in, say, a clockwise direction to close in the anti-clockwise direction, the latch fitting 24 is disconnected from the limb 4 rotated through 180° and then reconnected. The entry ramp 34 now faces in the opposite direction. The second support fitting is disconnected from the limb 2, turned through 180° and then reconnected and this means that the other helical ramp, which is of the opposite sense, now faces upwardly. The closing torque exerted on the gate when it is open, now acts in the opposite direction.

The invention claimed is:

1. A safety gate assembly including a frame, which may be secured across a door opening or stairway, said frame having two sides and comprising a base and at least one upstanding limb, and a gate having two sides, one of said sides of said gate is connected by at least one pivotal connection to said one limb of said frame to permit pivotal movement of said gate with respect to said frame about a pivotal axis and the other of said sides of said gate carries a latch member, which cooperates with a latch connected at the other of said sides of said frame, said latch defining a locked position, in which pivotal movement of said gate is prevented, said pivotal connection being constructed to permit linear movement of said gate relative to said frame in a direction parallel to said pivotal axis, said latch member cooperating with biasing means arranged to urge said latch member in the direction away from said one side of said gate, said latch defining a recess, which is adapted to accommodate a portion of said latch member and laterally adjacent which is an entry ramp and extending vertically into which is an exit ramp, said entry ramp being constructed and arranged so that, when said gate is pivoted into said locked position, said latch member engages said entry ramp and is moved by it progressively against the force of said biasing means in the direction towards said one side of said gate until said latch member is in registry with said recess and said biasing means then urges said latch member into said recess and further pivotal movement of said gate is prevented and said gate is in the locked position, said exit ramp being constructed and arranged so that, when said gate is moved linearly upwardly, said latch member engages said exit ramp and is moved by it progressively in the direction towards the said one side of said gate until it is out of said recess, whereafter said gate may be moved pivotally into an open position.

2. An assembly as claimed in claim 1 in which said frame is generally U-shaped and has two upstanding limbs and said latch is connected to the other of said upstanding limbs.

3. An assembly as claimed in claim 2 in which said latch is removably connected to said frame and is selectively connectable to said frame in orientations offset from one another by 180°, said latch affording two vertically extending exit ramps communicating with the top and bottom, respectively, of said recess.

4. An assembly as claimed in claim 1 in which said latch has a surface in which a depression is formed, wherein said depression extends on both sides of said recess and is thus divided by it into two portions, each having two ends, one end of one portion communicating with the entry ramp and the other end of said one portion communicating with said recess, one end of the other portion communicating with said recess and the other end of said other portion terminating before a side surface of said latch and thus constituting an abutment surface.

5. An assembly as claimed in claim 1 in which said latch member comprises an elongate pin, extending around which is a compression spring, which bears against said pin and said gate and constitutes said biasing means.

6. An assembly as claimed in claim 1 which includes a locking member, which is selectively movable between a locked position, in which it prevents linear movement of said gate relative to said frame, and a released position, in which it permits such linear movement.

7. An assembly as claimed in claim 1 in which said frame carries a support member, said support member defining at least one downward helical ramp on which said gate rests, said at least one ramp extending, when viewed from above, through the plane in which said gate extends, when it is in the closed position.

8. An assembly as claimed in claim 7 in which said gate has a projection on its underside which engages said at least one ramp.

9. An assembly as claimed in claim 7 in which said support member is removably connected to said frame and said at least one ramp defines two helical ramps which are oppositely inclined, said support member being selectively connectable to said frame such that a selected one of said two helical ramps is upwardly directed and supports said gate.

* * * * *